United States Patent [19]

Brashears

[11] 4,351,251

[45] Sep. 28, 1982

[54] COMBUSTION APPARATUS

[75] Inventor: David F. Brashears, Oviedo, Fla.

[73] Assignee: Mechtron International Corp., Orlando, Fla.

[21] Appl. No.: 278,825

[22] Filed: Jun. 29, 1981

[51] Int. Cl.[3] ..... F23D 1/02; F23C 1/10

[52] U.S. Cl. ..... 110/261; 431/173; 431/177; 110/262; 110/263; 110/264

[58] Field of Search ..... 110/260–265, 110/244; 431/173, 177

[56] References Cited

U.S. PATENT DOCUMENTS

| | | | |
|---|---|---|---|
| 1,618,808 | 2/1927 | Burg | 431/173 |
| 1,953,090 | 4/1934 | Vroom | 110/262 |
| 2,046,767 | 7/1936 | Campbell | 110/261 |
| 2,616,252 | 11/1952 | Robinson et al. | 110/263 |
| 2,800,093 | 7/1957 | Burg | 431/173 |
| 3,302,596 | 2/1967 | Zinn | 110/261 |
| 3,777,678 | 12/1973 | Lutes et al. | 110/244 |
| 3,951,584 | 4/1976 | Thekdi | 431/173 |
| 4,147,116 | 4/1979 | Graybill | 110/264 |
| 4,206,712 | 6/1980 | Vatsky | 110/261 |
| 4,223,615 | 9/1980 | Breen et al. | 110/264 |

*Primary Examiner*—Henry C. Yuen
*Attorney, Agent, or Firm*—William M. Hobby, III

[57] ABSTRACT

A combustion apparatus which has a burner having an inner wall lined with a refractory material forming a combustion chamber and an outer wall spaced from the inner wall by spacing members. A primary air supply supplies air to the burner combustion chamber through the outer and inner walls. A pulverizer for pulverizing solid fuel is connected to the primary air supply for feeding the pulverized solid fuel to the burner combustion chamber. A secondary air supply supplies air to the burner between the inner and outer walls and into the burner combustion chamber. The secondary air supply supplies air to an area of negative pressure in the combustion chamber created by the swirling flow of air from the primary and secondary air supply. An ignition pilot is mounted through the burner inner and outer walls adjacent to the primary air and fuel feed. The ignition pilot has a pilot flame detector which looks at the pilot and the main combustion flame. The primary air supply can also have a gas connection for supplying gas with the primary air supply and an oil atomizer gun can be attached for running the burner with fuel oil.

9 Claims, 7 Drawing Figures

FIG. 3
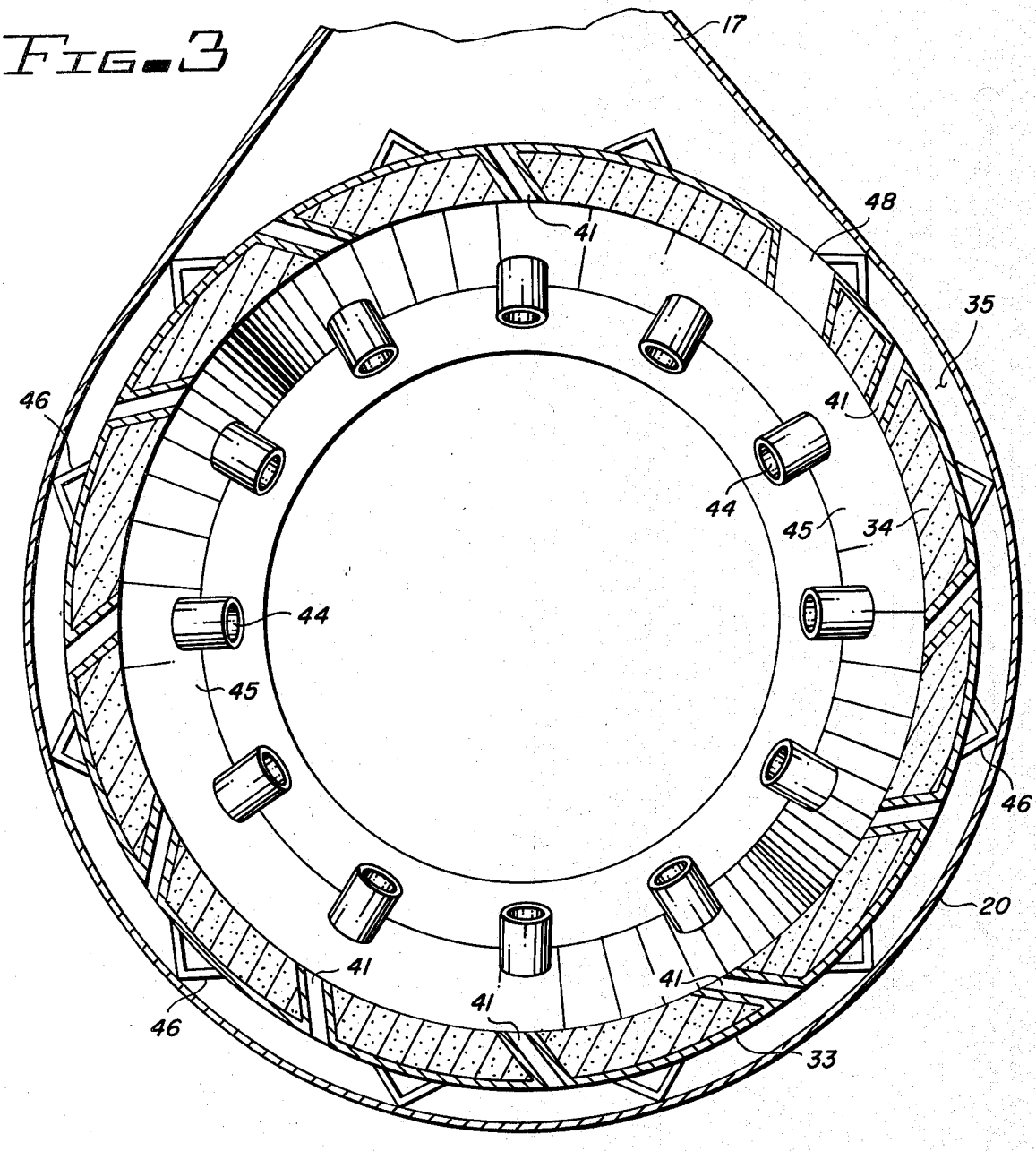
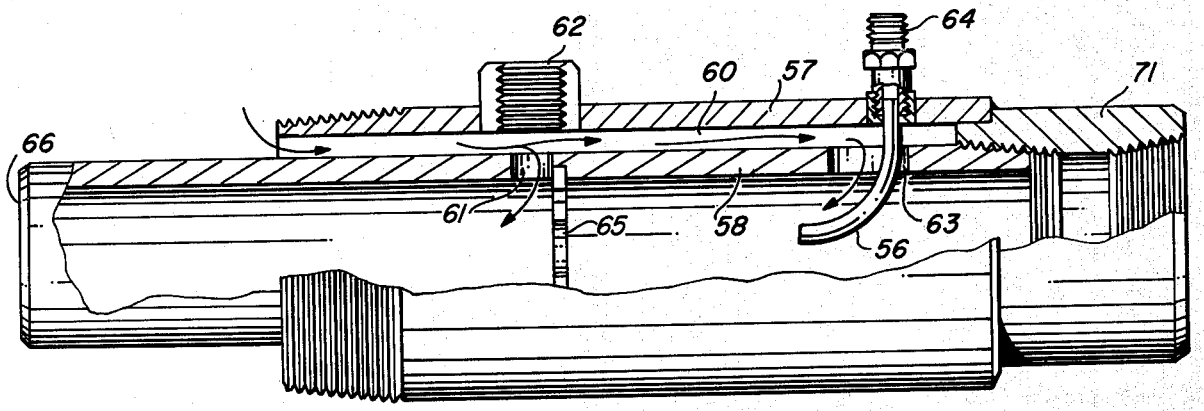
FIG. 6

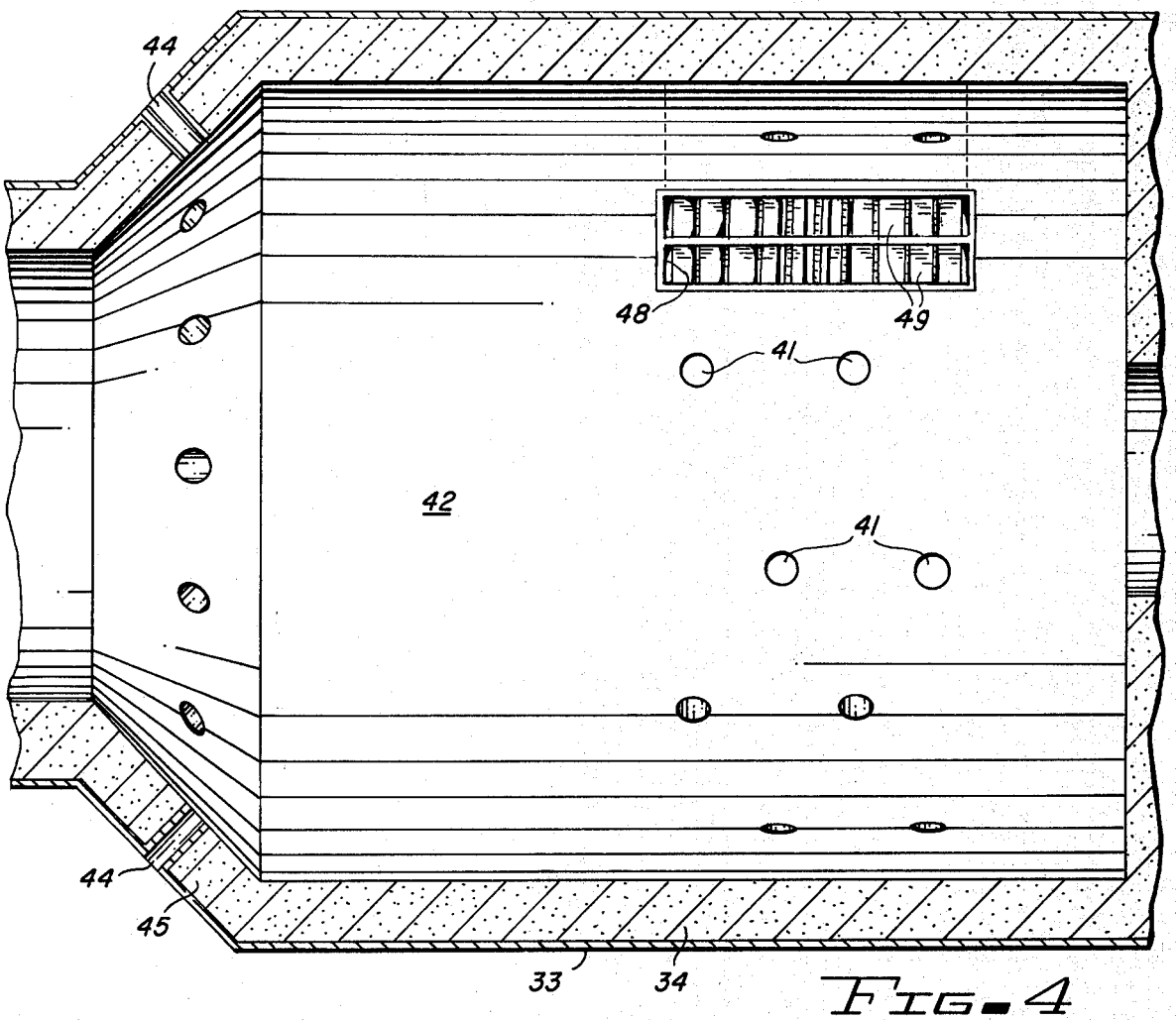
FIG. 4
FIG. 5
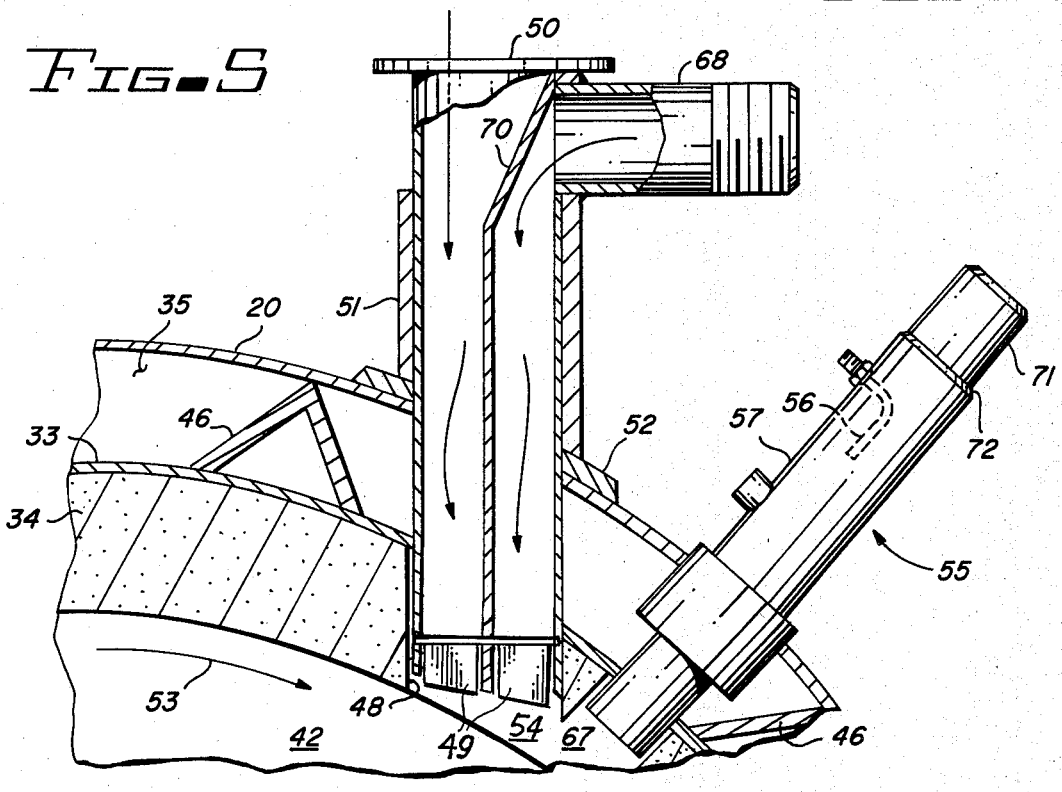

COMBUSTION APPARATUS

BACKGROUND OF THE INVENTION

The present invention relates to industrial burners and especially to industrial burners adapted to utilize a variety of fuels, including dehydrated pulverized organic materials.

Large, high capacity fuel burners are generally used in industries requiring drying of various materials. For example, such burners are required for operating large, rotary aggregate dryers and for kiln drying and processing of lime, bauxite, sand, coal, cement, and the like. In the making of asphalt roads, drying units are used for drying the aggregate before mixing with the asphalt.

In drying aggregate, as an example of an application of the fuel burners in consideration, a typical unit may have a rotating, horizontal drum 30 feet in length and 8 feet in diameter. The wet rock is introduced into one end of the drum, carried to the top of the drum and dropped back. The material is gradually carried to the opposite end of the drum and removed by a conveyor. A fuel burner, which may have an outlet chamber of from one or more feet in diameter is placed at one end of the drum. The hot gases and air eminating from the burner are directed through the falling aggregate, known as the aggregate curtain, and serves to dry out all moisture from the material. An exhaust fan at the output end of the drum draws the heated air therethrough. The gas temperature at the burning input end may be on the order of 2400° F., dropping to about 350° F. at the opposite end of the drum. In large dryers such as described above, the burners are required to produce as much as 200 million btu's per hour.

In the past, a variety of fuels have been utilized in burners, but by in large, recent burners have used natural gas or fuel oil. In recent years, the absence of certain types of fuels in different parts of the country have resulted in entire manufacturing plants not being able to operate because of the lack of the type of fuel the plant is designed to use. As a result of this, more and more industrial burners are designed to use more than one type of fuel, and may for instance, use pulverized coal and natural gas with the ability to switch from one to the other as price and availability dictate. It has also been suggested in prior years to utilize wood or other organic materials in pulverized form for operating burners. However, when fuel oil and natural gas were less expensive, systems using organic energy were not economically feasible. But, with a rapidly escalating price of oil, industrial burners which utilize pulverized organic materials appear to be more desirable.

In the present invention, organic materials are dehydrated and pulverized to a desirable moisture content of approximately twenty percent (20%). The desired particles are then forced at high pressure through pelletizing mills. The result is a pellet about a quarter of an inch in diameter and about three quarters of an inch long ($\frac{1}{4}'' \times \frac{3}{4}''$). These pellets then are used in specially designed industrial burners, which may also have the capability of using gas or oil as a back-up fuel. The pellets can be made from any vegetable or organic matter, such as scrapboard chips, hay, sugar cane, left over from forest products industries, municipal refuge and other waste materials that are generally regarded as sources of pollution. The cost of the pellets utilizing various and otherwise waste materials is now competitive with other fuels and in many cases, the cities are now paying to haul organic materials to landfills and to separate and sell the useable material to a pellet manufacturer. The present burner can then take pelletized material for operating the burners. But, in the event that sufficient pelletized material is not available, the burner can alternatively switch from the pellet fuel to oil or gas, or used dried organic material without pelletizing.

A typical U.S. patent which shows the use of pulverized fuel and oil either alone or simultaneously can be seen in U.S. Pat. No. 2,111,980 for a Combustion Apparatus. However, such prior art pulverized fuel burners have utilized pulverized coal and frequently have combined pulverization with gas or oil burners used in combination. Other powdered fuel burners can be seen in U.S. Pat. Nos. 1,618,808 and 3,777,678. These patents suggest using dual walled burners with combustion air being fed between the walls into the combustion chamber. The present invention is designed to operate in connection with pelletized organic material made from various forest products, waste, hay, sugar cane, and such, which has been dried and pelletized and is fed by the fuel to the burner.

SUMMARY OF THE INVENTION

The present invention relates to a combustion apparatus which has a burner having refractory lined inner walls to form a combustion chamber and outer walls having spacing members supporting the inner and outer walls from each other in a predetermined spaced relationship. The primary air supply supplies air to the burner combustion chamber through the space between the inner and outer wall and a pulverizer pulverizes a solid fuel and is connected to a primary air supply for feeding the pulverized solid fuel with the air supply being fed to the combustion chamber. An ignitor is positioned to ignite the fuel air mixture entering the combustion chamber. A secondary air supply supplies air between the inner and outer walls which is then directed to the burner combustion chamber in a predetermined manner, including into an area of negative pressure in the combustion area created by the spiralling flow of air in the combustion chamber. The pilot and ignition are connected at an angle to the input of the primary air and fuel supply and has an optical detector for detecting the pilot flame and the combustion flame. An oil gun is mounted for operating the combustion apparatus with fuel oil.

BRIEF DESCRIPTION OF THE DRAWINGS

Other objects, features and advantages of the present invention will be apparent from the written description and the drawings, in which:

FIG. 3 is a sectional view taken across the burner of FIGS. 1 and 2;

FIG. 4 is a sectional view taken through the combustion chamber;

FIG. 5 is a partial sectional view taken through the burner adjacent the ignition pilot assembly and primary air and fuel input;

FIG. 6 is a cutaway elevation of the ignition pilot assembly; and

DESCRIPTION OF THE PREFERRED EMBODIMENTS

Figure 1:
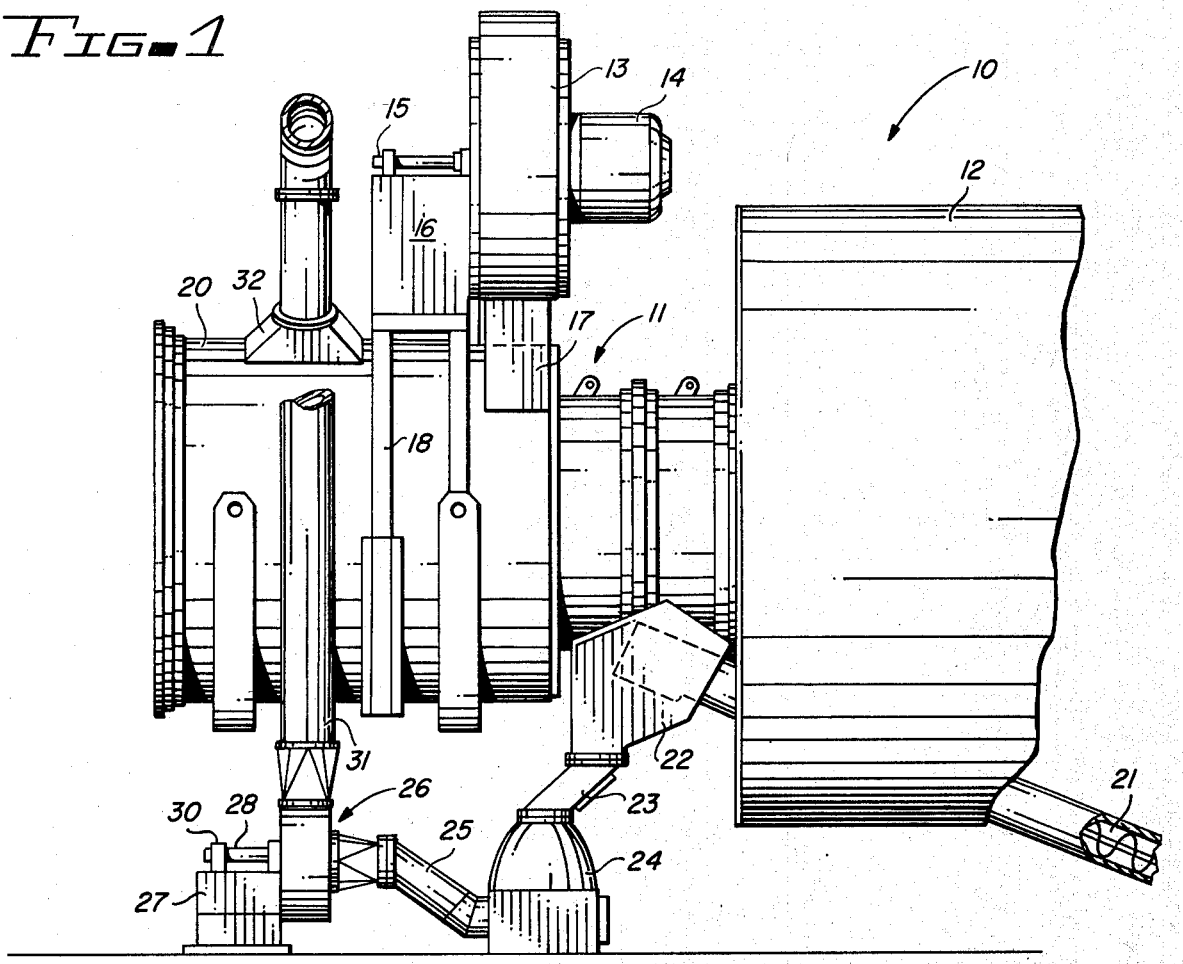
FIG. 1 is a side perspective view of a combustion apparatus in accordance with the present invention.

Referring to FIG. 1 of the drawings, the combustion system 10 has a burner 11 connected to a rotating drying drum 12 for drying aggregates, or the like, fed to the rotating drying drum 12. The burner 11 has a secondary air fan 13 driven by an electric motor 14 connected to a shaft 15 supported by a support 16. The fan discharge is connected to the top of the burner 11. The support 16 is supported by support legs 18 extending along the outside housing of the burner 11. The burner 11 has an outer housing or wall 20. The burner is adapted to operate on several types of fuel, alternatively or together, but is primarily adapted for using pulverized organic material, which is fed on a screw conveyor 21 to a feed hopper 22 having a rain hood thereover, which is connected by a chute 23 connected with magnetic adapters to a pulverized hammermill 24. The pulverizer 24 pulverizes the organic material which may be in the form of dried pellets made from scrap wood, sugar cane, left over forest products, hay, municipal refuge, and the like. Pulverized organic material is fed through a pipe 25 and into a primary air fan 26, sitting on a shaft support 27 supporting the shaft 28 and journals 30. The fan 26 directs pulverized organic material with a large amount of air under positive pressure through feed pipe 31 through the coupling 32 into the outer housing 20. An inner housing is spaced from the outer housing 20 as will be illustrated in later figures. The pulverized organic material, as well as gas and oil, are burned in the combustion chamber of the burner 11 to dry material in the rotating drum dryer 12.

The present invention is primarily directed towards the operation of the burn in the combustion chamber, which is specially adapted to handle pulverized solid materials.

Figure 2:
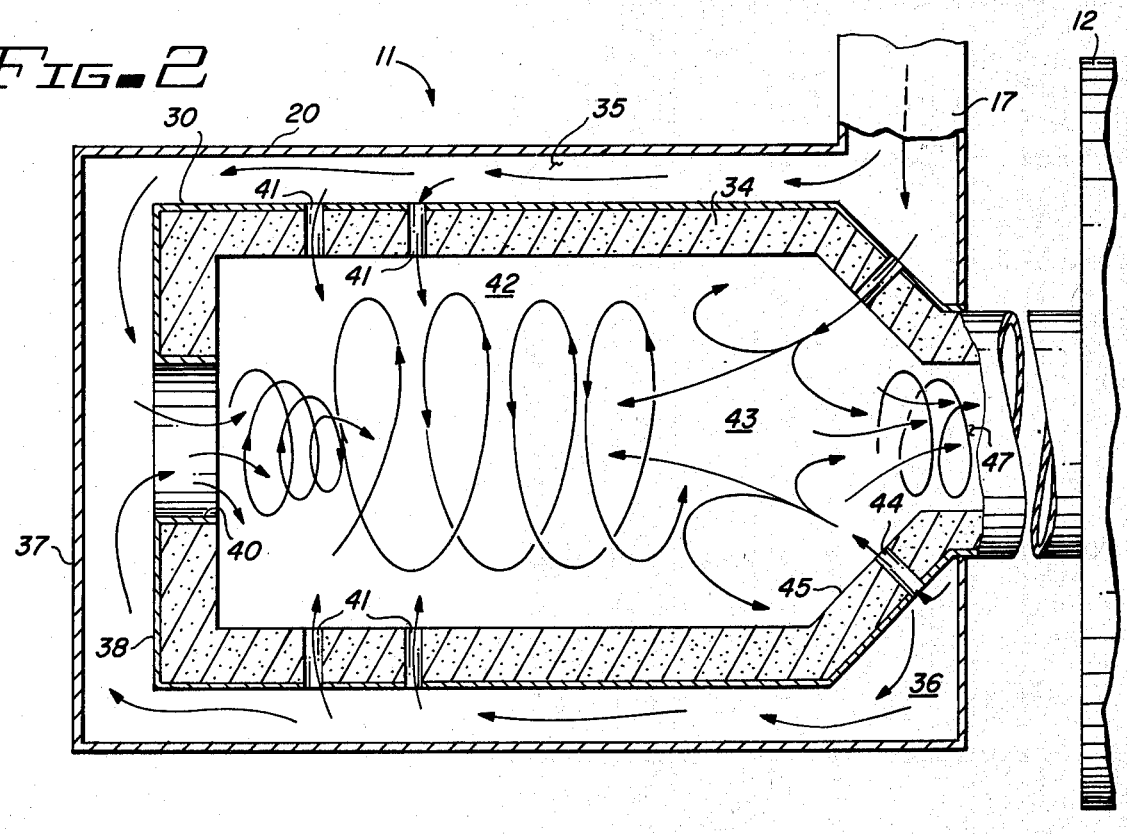
FIG. 2 is a sectional view taken through the combustion chamber of FIG. 1.

Turning to FIG. 2, a sectional view through the burner 11 shows the burner 11 connected to the rotating drum 12 with the secondary air fan 13 (FIG. 1) mounted above the burner 11. The outer wall 20 is connected with spacers (FIG. 3) to an inner wall 33 having a refractory lining 34 mounted thereon. Air from the fan 13 is driven between the walls 20 and 33 through the area 35. The fan 13 is blown directly into a plenum area 36 wrapped around the front portion of the burner 11 so as to direct air around all portions of the space between the wall 20 and 33 and around the rear end walls 37 and 38 and through an opening 40 into the combustion chamber. A plurality of staggered, angled openings 41 pass through the inner wall 33 and refractory material 34 into the combustion chamber 42 to create a swirling pattern within the combustion chamber in combination with the fuel feed, which is also directed at an angle into the combustion chamber. The swirling action creates an area of negative pressure located in the middle of swirl pattern as indicated by numeral 43 and a plurality of air openings 44 are located at an angle in front wall portion 45 to the combustion chamber 42 to direct the flow of air under pressure into the area of negative pressure created by the flow of air in a swirling pattern. In addition, air entering through the opening 40 enters towards the center rear of the combustion chamber and generates a similar swirling pattern. The pattern of the flow of air is indicated in the combustion chamber 42 by lines and arrows. The air being directed through the openings 44 in the wall 45 in a reverse direction to the flow of air serves to entrap heavier particles of fuel in the combustion chamber to combine a more complete combustion, while the staggered openings 41 maintains a swirling flow with the input of fuel into the combustion chamber.

Referring to FIGS. 3 and 4, a combustion chamber is more clearly illustrated in connection with the openings therein. The outer wall 20 has a plurality of structural spaces 46 attached to the inner wall 33 and to the outer wall 20 to maintain the walls in a predetermined spaced relationship depending upon the thickness of the angle iron spacers 46. The refractory material 34 lines the inner wall 33 and a plurality of staggered, angled air passageways 41 passes through the wall 33 and refractory material 34 into the combustion chamber by the air flowing through the passageways 41. The plurality of angled air nozzles 44 can be seen being directed into the combustion chamber into the drying drum. Pulverized fuel and air inlet 48 is more clearly indicated in connection with FIG. 5.

In FIG. 5, the outer housing wall 20 is seen having the spacers 46 connected to the inner wall 33 having the refractory material 34 attached thereto. The pulverized organic material is received at an input 50 delivered with a primary air source as illustrated in connection with FIG. 1, and is fed into the combustion chamber 42 through the opening 48 having the feed tube 51 protruding thereinto and supported with a flange 52 to the outer wall 20. The air from the staggered angled openings 41 proceeds in a direction as shown by the arrow 53 past the opening 54 from the fuel inlet pipe 51, also at an angle, to continue the swirling flow within the combustion chamber 42. The fuel is ignited with an ignition pilot assembly 55 having a gas pilot 56 protruding into a tube 57 having an inner wall 58, which may also be seen in connection with FIG. 6. A passageway 60 is formed between the outer wall 57 and the inner wall 58 and is connected only to the outer wall 20 to allow the flow of air in the space 35 to enter through the spacing 60 and out an opening 61 adjacent the positioning of a spark plug and out an opening 63 around the gas pilot 56. The gas pilot has a coupling 64 which is connected to a gas line, which is ignited by the spark plug mounted at 62. The air directs the gas being fed in the pilot 56 through a stabilizing plate 65 and out the end 66 to ignite a solid fuel being fed through the opening 54 past the opening 67 for the ignition pilot assembly 55. A gas line 68 is attached to the fuel input 50 and is separated by a plate 70 from the input of pulverized solid fuel and air so gas can be burned with the solid fuel or separately, as desired. The ignition assembly has a photo detector 71 which is an ultraviolet scanner attached to the end of 72 of the pipe 57 to look directly into the pipe and thereby indicate whether the pilot light is on or off and by looking directly through the inner tube 57 to read the primary flame when the pilot is not burning. Thus, a single scanner located outside the combustion chamber reads both the pilot and the main flame, since the flame's spread is direclty across the opening 67 from the opening 54.

Figure 7:
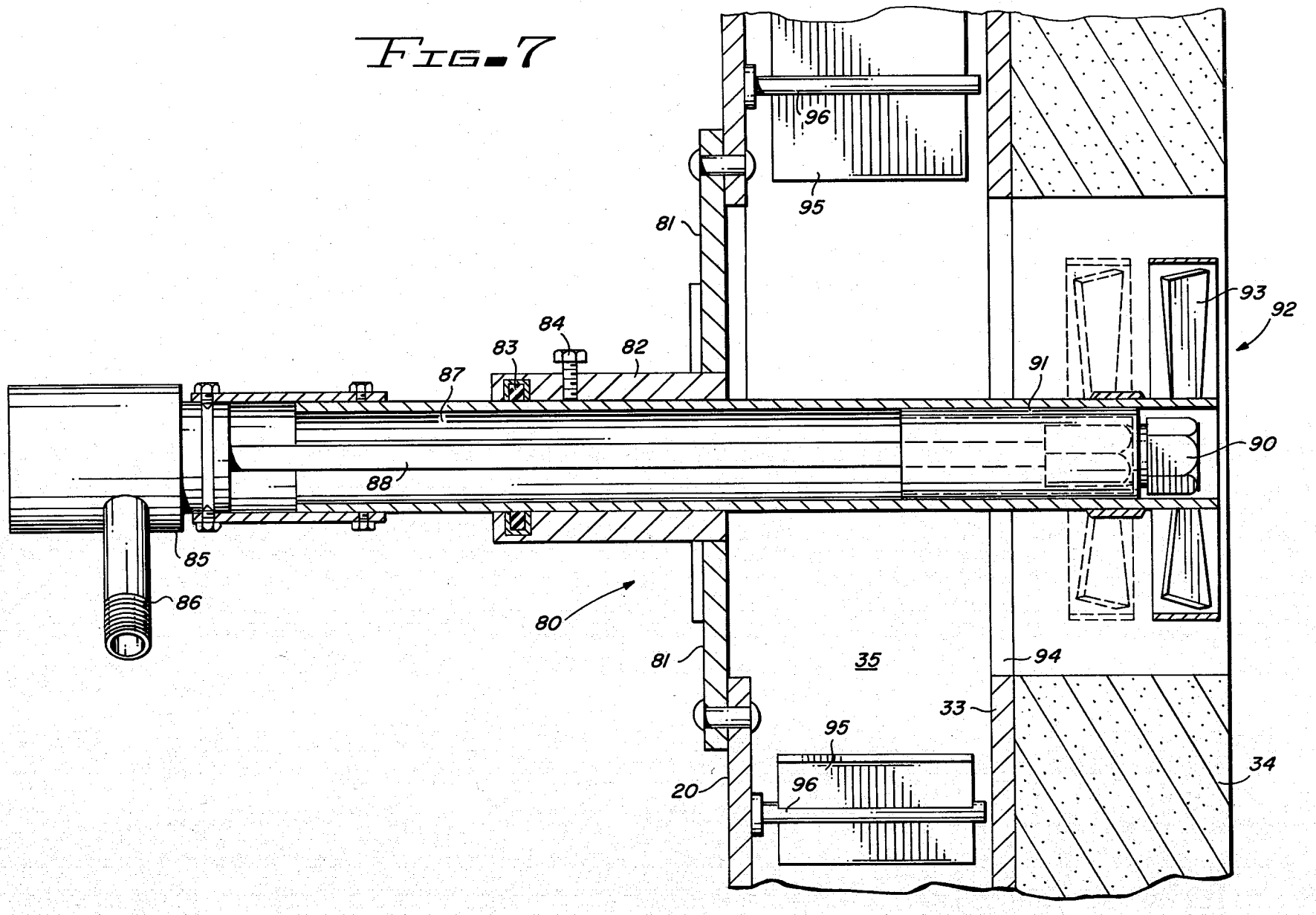
FIG. 7 is a sectional view of an oil atomizer during assembly.

In addition to operating on pulverized solid fuel and on gas, the present combustion system can operate on oil with an atomizer gun assembly 80 in FIG. 7, which has a mounting plate 81 and a mounting tube 82 attached thereto, along with seals 83 and is adapted to be locked with bolt 84. An atomizer gun weldment 85 is attached to one end and an oil input tube 86 is connected thereto. An air pipe is also connected to the weldment and passes through the passageway 87 while the oil passes through a tube 88 into the nozzle 90. The sliding tube 91 allows the diffuser 92 having diffuser blades 93 therein to be slid in right along with the nozzle 90 to position the nozzle end oil diffuser in different positions, which can then be locked with the bolt 84. The atomizer gun assembly mounting plate 81 is mounted to the outer wall 20 having the inner wall 33 and refractory material 34 spaced therefrom with the air spacing 35 feeding air through the air opening 94 around the tube 91. Rotatable vanes 95 may be mounted on shafts 96 for adjustment and directing the flow of air from the spacing 35 through the opening 34 as desired.

It should be clear at this point that a multi-fuel combustion system has been provided which is especially adapted for use in connection with pulverized organic materials and which feeds air in such a manner as to provide a more complete combustion of the solid fuel. In addition, the flow of air between the inner and outer walls and through angled openings cools the inner and outer walls and refractory material by the flow of air therebetween and by feeding of air in a swirling pattern around the combustion chamber. This system is readily adaptable to be used with gas and oil, as illustrated, in the event of shortage of dried, pelletized, organic materials. The invention is, however, not to be construed as limited to the forms shown, which are to be considered illustrative rather than restrictive.

I claim:

1. A combustion apparatus comprising in combination:

a burner having an inner refractory wall forming a combustion chamber and an outer wall and a plurality of spacing members supporting said inner wall and outer wall in a predetermined spaced relationship to each other;

primary air supply means for supplying air to said burner combustion chamber through said refractory wall;

pulverizing means for pulverizing solid fuel, said pulverizing means being connected to said primary air supply for feeding said pulverized solid fuel to said primary supply and to said burner combustion chamber with said primary air;

secondary air supply means for supplying a source of air to said burner, said secondary air supply means being connected to said burner to direct air between said inner and outer walls and through a plurality of openings through said inner wall into said combustion chamber at an angle to the inner surface of said combustion chamber; and a portion of said openings through said inner wall being through an angled inner wall portion for directing air under pressure into an area of negative pressure in said combustion area chamber created by the flow of air by said primary air supply and other angled air openings to burn said pulverized solid fuel.

2. A combustion apparatus in accordance with claim 1, in which said primary air supply means inclues distribution vanes at the opening of said primary supply means into said combustion chamber for distribution of said primary air and fuel in said combustion chamber.

3. A combustion apparatus in accordance with claim 1, in which said combustion chamber inner wall is generally cylindrical shaped and angled at one end to connect with a smaller cylindrical shaped portion of said inner wall and said portion of said openings through said inner wall being through said angled inner wall portion.

4. A combustion apparatus in accordance with claim 3, in which a gas inlet is mounted adjacent said primary air supply means opening to said combustion chamber.

5. A combustion apparatus in accordance with claim 4, in which an ignition pilot means is positioned adjacent said primary air supply means to face said primary air opening into said combustion chamber and a pilot flame detector means for detecting said pilot gas mounted at one end of said ignition pilot means, said pilot flame detection means facing said burner flame for detecting pilot flame and the combustion flame of said combustion burner.

6. A combustion apparatus comprising in combination:

a burner having outer and inner walls spaced with spacing members in a predetermined spaced relationship to each other;

said inner wall forming a combustion chamber thereinside;

solid fuel input means passing through said burner outer and inner walls for directing fuel into said combustion chamber;

a source of air directed into the space between said inner and outer walls;

a plurality of passageways through said inner walls for directing air from said source of air through said openings into said combustion chamber, said plurality of passageways including angled passageways, staggered in said inner wall and directed into the primary burn zone; and reverse air jets for directing air through one end of inner wall into an area of negative pressure generated by said staggered angled air jets in said combustion chamber.

7. A combustion apparatus in accordance with claim 6, in which said inner wall forming a combustion chamber thereinside is generally cylindrical shaped and angled at one end to connect to a smaller cylindrical shape and said reverse air jets are mounted in said angled portion of said inner wall of said combustion chamber.

8. A combustion apparatus in accordance with claim 7, in which said fuel input means includes an input for pulverized solid fuel and air and had a connection for gas fuel adjacent thereto and said fuel input means further having a plurality of vanes mounted for directing said input fuel to either side of said fuel input means opening into said combustion chamber.

9. A combustion apparatus in accordance with claim 8, in which an ignition pilot means is positioned adjacent said fuel input means and has a pilot flame detector means with a flame scanner for detecting said pilot gas flame mounted for detecting said pilot flame and said combustion flame with a single flame scanner.

* * * * *